United States Patent [19]

Kovic et al.

[11] 4,238,081

[45] Dec. 9, 1980

[54] APPARATUS FOR STORING FILAMENTARY MATERIAL

[75] Inventors: Ferdinand Kovic, Radolfzell; Peter Jung, Constance, both of Fed. Rep. of Germany

[73] Assignee: Sulzer Brothers Limited, Winterthur, Switzerland

[21] Appl. No.: 6,798

[22] Filed: Jan. 25, 1979

[30] Foreign Application Priority Data

Jan. 30, 1978 [CH] Switzerland ..... 976/78

[51] Int. Cl.[3] ..... B65H 51/20

[52] U.S. Cl. ..... 242/47.01; 139/452

[58] Field of Search ..... 242/47.01–47.13, 242/47, 82, 83; 139/452; 66/132 R

[56] References Cited

U.S. PATENT DOCUMENTS

| | | | |
|---|---|---|---|
| 3,455,341 | 7/1969 | Pfarrwaller et al. | 139/452 |
| 3,720,384 | 3/1973 | Rosen | 242/47.01 |
| 3,761,031 | 9/1973 | Pfarrwaller | 242/47.01 |
| 3,971,522 | 7/1976 | Pfarrwaller | 242/47.01 |
| 4,116,397 | 9/1978 | Burgbacher | 242/47.01 |

*Primary Examiner*—Stanley N. Gilreath
*Attorney, Agent, or Firm*—Kenyon & Kenyon

[57] ABSTRACT

The means for storing material in filamentary form comprises basically a tension member consisting of elastic material, e.g. plastics or rubber, which is fitted into the bobbin of the storage system and serves to support components situated inside the bobbin. Such components may, for example, be retaining magnets for securing the bobbin against rotation, or a reflective strip for a photoelectric cell system for controlling the axial length of the yarn package formed on the bobbin. The tension member is secured in the bobbin by means of noses or ribs and associated recesses. The components to be fitted in the bobbin, e.g. magnets or reflective strips, are also secured by suitable projections on the tension member or resilient tabs. The tension member and the components to be mounted in the bobbin can readily be removed therefrom.

15 Claims, 2 Drawing Figures

APPARATUS FOR STORING FILAMENTARY MATERIAL

This invention relates to an apparatus for storing filamentary material. More particularly, this invention relates to an apparatus for storing yarn for use in a textile machine.

Heretofore, it has been known to store filamentary material, such as yarn, wire, strip and the like, on bobbins by winding the material about an outer substantially cylindrical surface of the bobbin. Generally, these bobbins contain storage components which are introduced internally into the bobbins in order to effect a storage operation. For example, the bobbins frequently have magnets inserted therein for the purpose of securing the bobbin against rotation by cooperating with external permanent magnets. Also, in some cases, the storage components include components which are utilized to control the axial length of a stored package.

In one known storage system for yarn, for example as described in Swiss Pat. No. 569,655, magnets which are used to secure the system against rotation are fixed inside the bobbin by means of an adhesive. Other storage components, such as a reflective strip which forms part of a photoelectric cell system controlling the axial package length, are also stuck in the bobbin. However, in such conditions, it is difficult to position the components, e.g. the magnets, in the specified position. Further, some time is required before the adhesive has dried and the magnets are fixed.

Accordingly, it is an object of the invention to provide an apparatus of relatively simplified construction for storing filamentary material.

It is another object of the invention to provide a system for storing filamentary material which can be readily assembled.

It is another object of the invention to provide a simplified mounting of storage components within a bobbin of a yarn storage system.

Briefly, the invention provides an apparatus for storing filamentary material which includes a bobbin with a substantially cylindrical peripheral surface to receive windings of a filamentary material and an internal cavity for receiving storage components, and a tension member which is made at least partially of elastic material and is fitted into the bobbin cavity for securing the storage components herein. The tension member which is mounted under tension inside the bobbin enables the storage components to be readily introduced in the exact position and to be easily removed.

Figure 2:
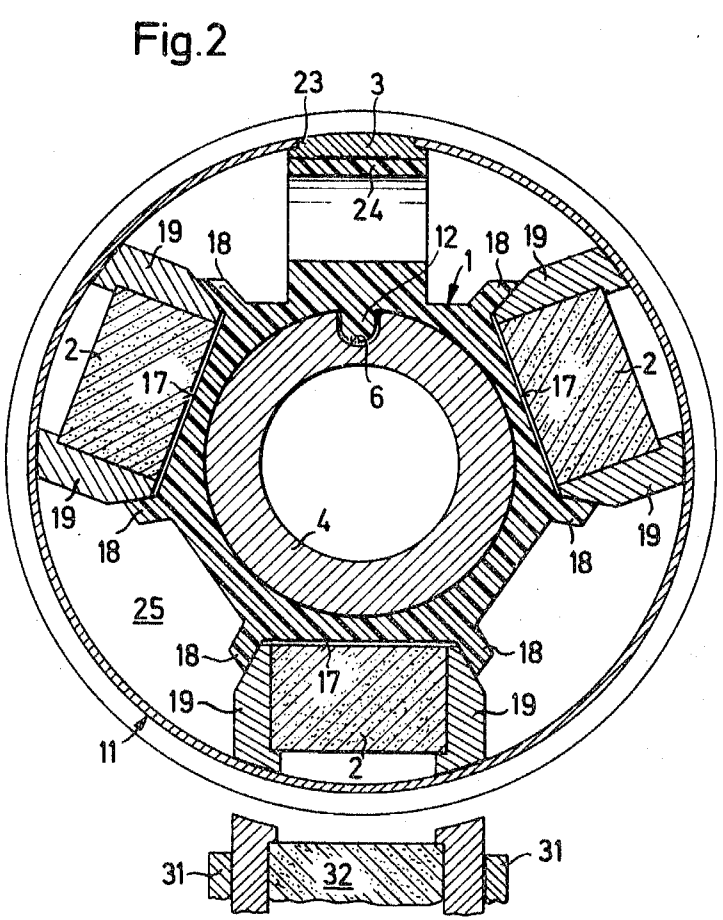
Figure 1:
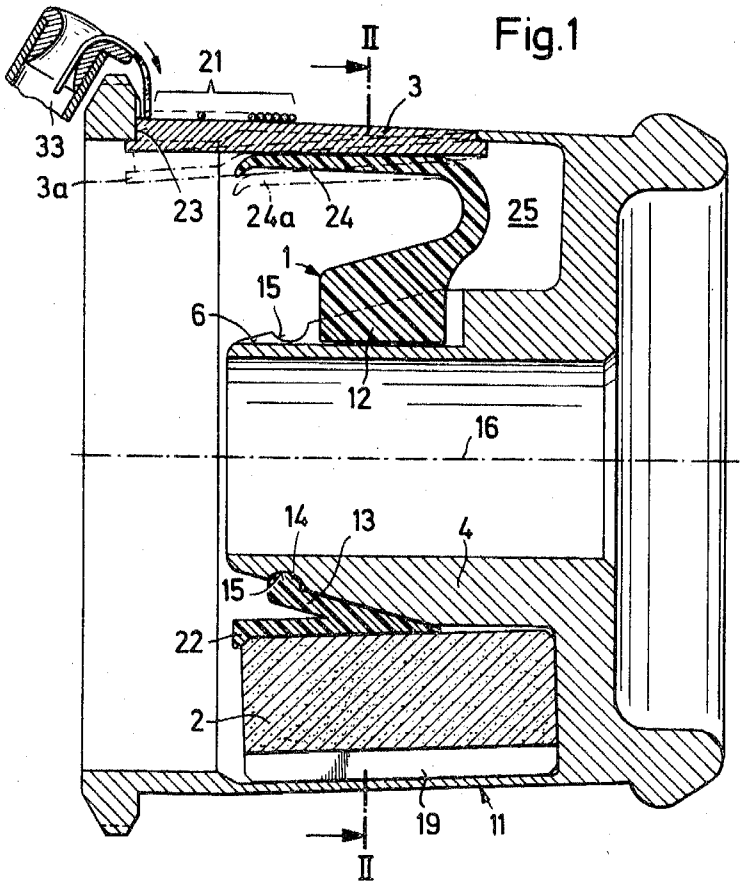

These and other objects and advantages of the invention will become more apparent from the following detailed description and appended claims taken in conjunction with the accompanying drawings in which:

FIG. 1 illustrates a longitudinal sectional view of an apparatus according to the invention; and FIG. 2 illustrates a view taken on line II—II of FIG. 1.

Referring to FIGS. 1 and 2, the apparatus for storing a filamentary material includes a bobbin 11, storage components in the form of a plurality of magnets 2 and a light reflective strip 3, and a tension member 1 which secures the magnets 2 and strip 3 within the bobbin 11.

As shown in FIG. 1, the bobbin 11 has a substantially cylindrical peripheral surface of generally known contours to receive windings 21 of a filamentary material, e.g. a yarn. In addition, the bobbin 11 has a hub 4 of annular shape which is disposed coaxially of a longitudinal axis 16 of the bobbin 11. As indicated, the hub 4 has an outer surface which is initially conical and which merges into a cylindrical shape before merging into the remainder of the bobbin 11. Still further, the bobbin 11 has an internal cavity 25 formed between the hub 4 and the outer part of the bobbin 11 forming the peripheral surface as well as an aperture 23 formed in the peripheral surface to communicate with the cavity 25.

Referring to FIGS. 1 and 2, the tension member 1 has a central portion which defines a shaped bore so as to be fitted onto the hub 4 of the bobbin 11. As indicated in FIG. 1, the central portion is internally tapered to fit onto the conical portion of the hub 4. The member 1 also has three outwardly directed peripheral recesses 17 for receiving the magnets 2. Each recess 17 includes a boundary tab 18 (FIG. 2) along each opposite longitudinal side to hold a magnet 2 against circumferential movement relative to the recess 17 and a nose 22 (FIG. 1) at one end for retaining a magnet 2 against axial movement relative to the recess 17. As shown in FIG. 2, each magnet 2 is of the permanent type and is held in a recess 17 by pole shoes 19.

The tension member 1 also has a radially outwardly directed retaining means in the form of a resilient tab 24 for securing the reflective strip 3 relative to the bobbin 11. As shown in FIG. 1, the tab 24 is of folded-over configuration so as to be biased radially outwardly to hold the strip 3 in the aperture 23 from within the cavity 25.

In order to prevent rotation of the tension member 1 relative to the bobbin 11, the central portion of the tension member 1 is formed with a longitudinal projection 12 which is directed radially inwardly to fit within a longitudinal groove 6 in the hub 4. Further, in order to secure the tension member axially relative to the bobbin 11, the central portion of the tension member 1 has at least one resilient tab 13 extending from one end, as shown with a radially inwardly directed projection 14 fitting into an annular groove 15 in the hub 4.

The tension member 1 is made at least partially of elastic material for example of rubber and may be constructed of a plurality of parts. As shown, the member 1 is of one piece construction and is made of plastics, e.g. of Nylon, Teflon or the like.

The magnets 2 serve to secure the bobbin 11 against rotation during operation by use of an associated stationary permanent magnet 32 disposed in a machine frame 31 so that the windings 21 of a yarn package can be formed by a rotating yarn guide 33 in known manner.

The reflective strip 3 is made, for example of Scotchlight, and has a peripheral shoulder so as to be abutted against the bobbin 11 about the aperture 23.

In use, the tension member 1 with the magnets 2 in the recesses 17 can be pushed into the bobbin cavity 25 and fitted in place on the hub 4 by snapping of the projection (s) 14 into the groove 15. The reflective strip 3 can then be inserted in the aperture 23 by pressing down the tab 24 to provide access to the aperture 23.

In order to change the reflective strip 3, the strip 3, is pressed downwards as viewed into the chain-line position **3*a*, 24*a* in FIG. 1, the tab 24 being pressed down for this purpose. The strip 3** can then be removed to the left with reference to FIG. 1.

The tension member 1 and magnets 2 can be removed to the left with reference to FIG. 1 by opening the tabs 13, i.e. by deflecting the tabs 13 outwardly to disengage the projections 14 from the groove 15.

The tension member 1 can be used both for a package forming system comprising a stationary bobbin 11 (as described above) and a system having a rotating bobbin. Further, the means for securing the member 1 axially and against rotation can be constructed in various ways and depend on the configuration of the bobbin 11 and particularly the internal configuration of the bobbin 11.

Of course, other components required for the package forming system can be held inside the bobbin 11 by means of the tension member 1. The latter must then be given a corresponding configuration.

The parts 12, 6 and 14, 15 from positive and nonpositive means of securing the member 1 in the bobbin 11. The noses 22 and tabs 24 represent non-positive and positive means for retaining the magnets 2 and the reflective strip 3 in the bobbin 11.

The system described may be used as a means of storing weft yarn, for example, in conjunction with a weaving machine.

What is claimed is:

1. An apparatus for storing filamentary material, said apparatus comprising a bobbin having a substantially cylindrical peripheral surface to receive windings of a filamentary material thereon, an internal cavity for receiving storage components and on integral centrally disposed hub within said cavity; and a tension member fitted into said cavity of said bobbin over said hub for securing the storage components therein.

2. An apparatus as set forth in claim 1 wherein one of said bobbin and said member has at least one groove therein and the other of said bobbin and said member has a projection disposed in said groove to secure said bobbin and said member against relative movement.

3. An apparatus as set forth in claim 1 wherein said member has outwardly directed retaining means for securing a storage component within said bobbin.

4. In combination, a bobbin having an outer peripheral surface to receive windings of a filamentary material thereon, an internal cavity and an integral centrally disposed hub within said cavity;

at least one storage component within said cavity for effecting storage of the windings of filamentary material on said bobbin surface; and a tension member made at least partially of elastic material, said member being fitted into said cavity of said bobbin over said hub to secure said storage component therein.

5. The combination as set forth in claim 4 wherein said storage component is a magnet and said tension member has an outwardly directed recess receiving said magnet therein, said magnet being disposed against said bobbin under the force of said tension member.

6. The combination as set forth in claim 4 wherein said bobbin has an aperture in said peripheral surface and said storage component is a light-reflective strip disposed across said aperture and said tension member has an outwardly directed retaining means securing said strip relative to said bobbin.

7. The combination as set forth in claim 4 which includes a plurality of storage components, said components including a plurality of magnets and a light-reflective strip disposed across an aperture in said bobbin, and wherein said tension member includes a plurality of circumferentially-spaced outwardly-directed recesses, each said recess receiving a respective magnet therein and an outwardly directed retaining means securing said strip relative to said bobbin.

8. The combination as set forth in claim 7 wherein said retaining means is a resilient tab.

9. The combination as set forth in claim 4 wherein one of said bobbin and said member has at least one groove therein and the other of said bobbin and said member has a projection disposed in said groove to secure said bobbin and said member against relative movement.

10. A tension member for holding at least one filament storage component in a cavity of a bobbin, said tension member being made at least partially of elastic material with a central portion defining a shaped bore, at least one outwardly directed peripheral recess for receiving a storage component, and at least one radially outwardly directed resilient tab.

11. A tension member as set forth in claim 10 which further includes a projection on said central portion directed radially inwardly into said bore and at least one resilient tab at one end of said central portion having a radially inwardly directed projection thereon.

12. A tension member as set forth in claim 10 which further includes a nose at one end of said recess for retaining a storage component therein against axial movement relative to said recess in at least one direction.

13. A tension member as set forth in claim 10 of one-piece plastics construction.

14. In combination, a bobbin having an outer peripheral surface to receive windings of a filamentary material thereon, an aperture in said peripheral surface and an internal cavity;

a light-reflective strip disposed across said aperture for effecting storage of the windings of filamentary material on said bobbin surface; and a tension member made at least partially of elastic material, said member being fitted into said cavity of said bobbin and having an outwardly directed retaining means securing said strip relative to said bobbin.

15. In combination, a bobbin having an outer peripheral surface to receive windings of a filamentary material thereon and an internal cavity;

a plurality of storage components within said cavity for effecting storage of the windings of filamentary material on said bobbin surface, said components including a plurality of magnets and a light-reflective strip disposed across an aperture in said bobbin; and a tension member made at least partially of elastic material, said member being fitted into said cavity of said bobbin to secure said storage components therein, said tension member including a plurality of circumferentially-spaced outwardly-directed recesses, each said recess receiving a respective magnet therein and an outwardly directed retaining means securing said strip relative to said bobbin.

* * * * *